US006205693B1

(12) United States Patent
Pliler et al.

(10) Patent No.: US 6,205,693 B1
(45) Date of Patent: Mar. 27, 2001

(54) SOUVENIR HOLDER

(76) Inventors: David B. Pliler, 3261 Sepulveda Blvd. 101, Los Angeles, CA (US) 90034; Matthew A. Stevens, 1232 E. Elmwood Ave., Burbank, CA (US) 91501

( * ) Notice: Subject to any disclaimer, the term of this patent is extended or adjusted under 35 U.S.C. 154(b) by 0 days.

(21) Appl. No.: 09/314,190

(22) Filed: May 19, 1999

(51) Int. Cl.[7] ..... A47G 1/06
(52) U.S. Cl. ..... 40/776; 40/537; 40/771
(58) Field of Search ..... 40/323, 530, 537, 40/775, 776, 124.2, 765, 771, 661

(56) References Cited

U.S. PATENT DOCUMENTS 1,719,962 * 7/1929 Beistle ..... 40/537 X
2,318,850 * 5/1943 Grant ..... 40/776 X
2,521,792 * 9/1950 Hollander ..... 40/537 X
3,245,166 * 4/1966 Hagner ..... 40/530 X
4,468,053 * 8/1984 Bradley ..... 40/537 X
4,702,026 * 10/1987 Shaine ..... 40/776
5,119,574 * 6/1992 King ..... 40/537

* cited by examiner

*Primary Examiner*—Terry Lee Melius
*Assistant Examiner*—James M Hewitt
(74) *Attorney, Agent, or Firm*—Baker & Maxham

(57) ABSTRACT

A holder for holding and displaying coins and souvenirs, has a front panel and a back panel secured together to hinge about a common axis along a common edge, and an inner panel pivotally secured to hinge about a common axis along a common edge of the back panel, a mounting face on the inside surface of each of the front and back panels, and a mounting face on opposite faces of the inner panel, or on loose sheets that can be added or removed, such as a three ring binder, each mounting face is formed with a plurality of vertically spaced rectangular surfaces, each rectangular surface having a pair of laterally disposed mounting positions for receiving and mounting a coin or souvenir, each mounting position defined by a planar surface bound by an upper and a lower groove, and a transparent retaining sheet covering each of the mounting positions.

17 Claims, 3 Drawing Sheets

SOUVENIR HOLDER

BACKGROUND OF THE INVENTION

The present invention relates to collectors albums or holders and pertains particularly to an album or holder for souvenir coins and the like.

Many people collect various souvenirs from the many places they visit during a lifetime. Some of the souvenirs when similar in size and structure are mounted in holders for convenience of display. One particularly popular souvenir currently available from many museums and entertainment centers is a stretched or distorted coin. The coin is usually a penny which is placed in a machine that reforms the coin into a thinner oval configuration. The machine also usually embosses symbols, logos and wording indicating the place visited on the face of the coin.

Accordingly, there is a need for a suitable holder available that would hold and display the souvenirs in a convenient, secure and attractive manner.

SUMMARY AND OBJECTS OF THE INVENTION

It is the primary object of the present invention to provide an improved and suitable holder to conveniently hold and display the souvenirs in a secure and attractive manner.

In accordance with a primary aspect of the invention, a souvenir holder for holding and displaying souvenirs, comprises at least a front panel and a back panel secured together to fold about a common axis, a mounting face on the inside surface of each of said front and back panels, each mounting face having a plurality of mounting positions for receiving and mounting a coin, and a transparent retaining cover over each of said mounting positions.

BRIEF DESCRIPTION OF THE DRAWINGS

The above and other objects and advantages of the present invention will become apparent from the following description when taken in conjunction with the accompanying drawings wherein.

DETAILED DESCRIPTION OF THE PREFERRED EMBODIMENT

Figure 1:
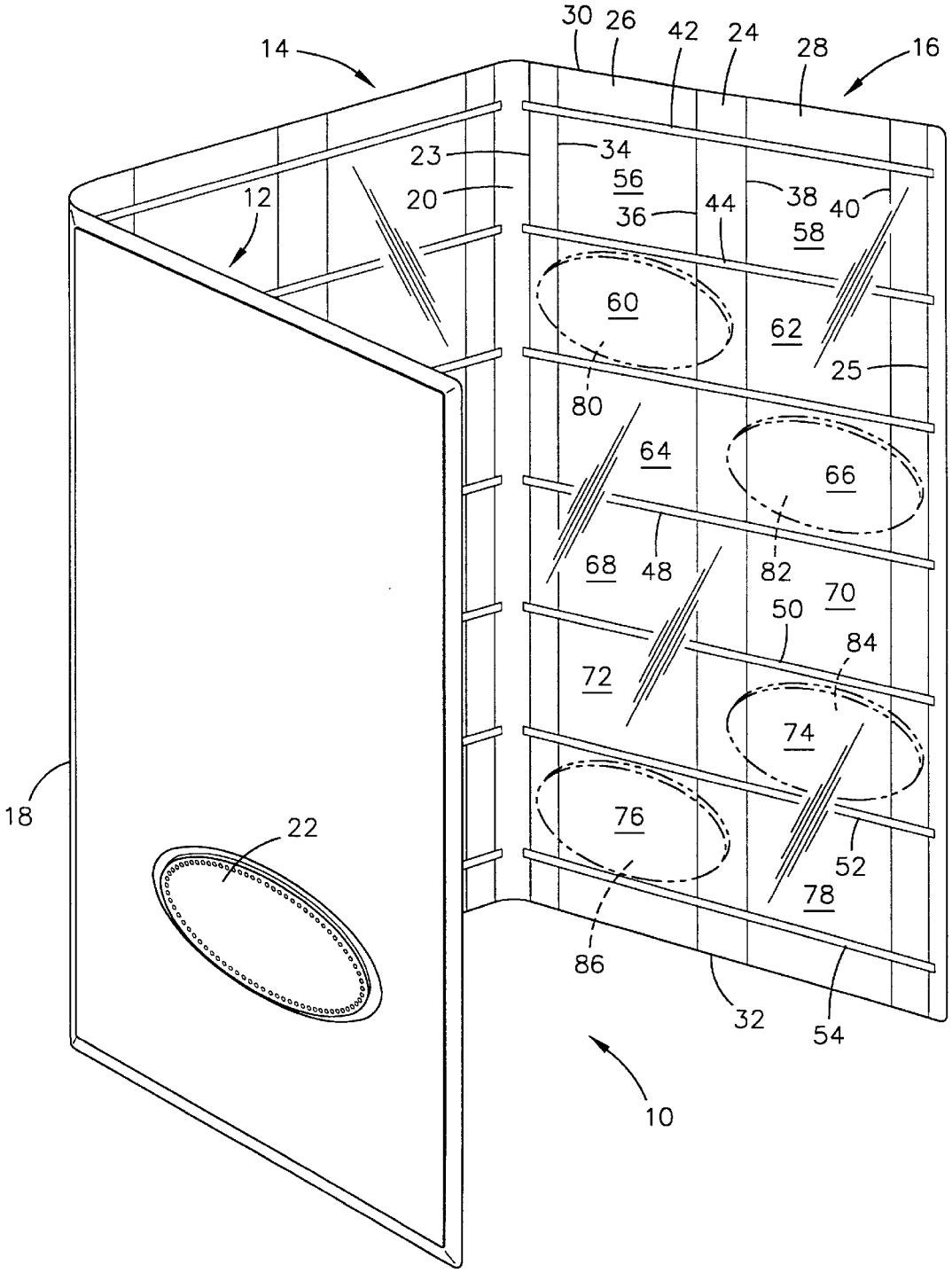
FIG. 1 is a perspective view of a souvenir holder in accordance with an exemplary embodiment of the invention shown in an open position.

Referring to FIG. 1, a coin or souvenir holder in accordance with an exemplary embodiment of the present invention is illustrated and designated generally by the numeral 10. The illustrated holder is shown in an open position and comprises a tri-panel or tri-fold panel array with a first or cover panel 12 hinged or pivotally connected along one edge to a second or back panel 14 which, in turn, is hingedly or pivotally-connected along a common edge with third or inner panel 16. The holder of course can be a single panel or comprise any number of multiple panels. The panels are each preferably semi- or substantially rigid made such as, for example, of panels of cardboard or the like covered such as by a coating of vinyl or other suitable elastomeric material forming what is known as live hinges 18 and 20 between the panels. These live hinges are formed between common side edges of front panel 12 and back panel 14 and between common edges of back panel 14 and inner panel 16. The inner panel 16 folds inward against the inner face of panel 14 and the front cover panel 12 folds over onto the inner panel 12. Thus the inner panel 16 is folded and sandwiched between the front and back panels 12 and 14 when the holder is closed.

The illustrated holder was devised primarily to hold certain souvenirs formed from coins and tokens, such as pennies, dimes, quarters, transit tokens and the like. These souvenirs are formed in a vending type machine which acts by the flattening of a penny, token or other coin in the machine such that the penny takes on an oval configuration. The coin is rolled in the machine which also typically stamps or otherwise applies various symbols, words and/or logos to the surface of the coin. The holder of the present invention is formed with a transparent pocket on the front cover for the receipt of a coin 22 which in the present use serves as a logo.

Figure 2:
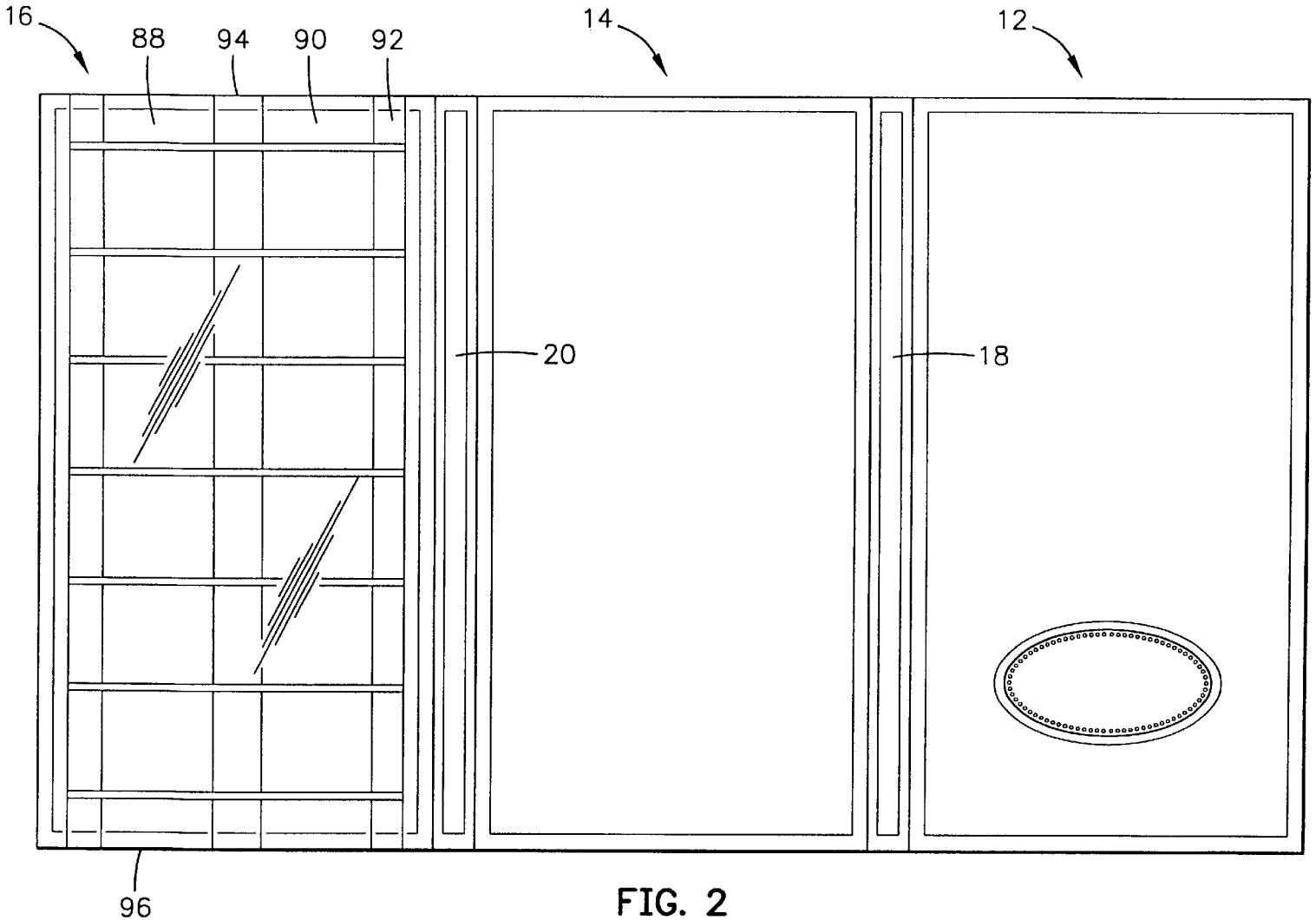
FIG. 2 is an elevation view showing the holder open showing the front and back surfaces and one face of the interior mounting panel.
Figure 3:
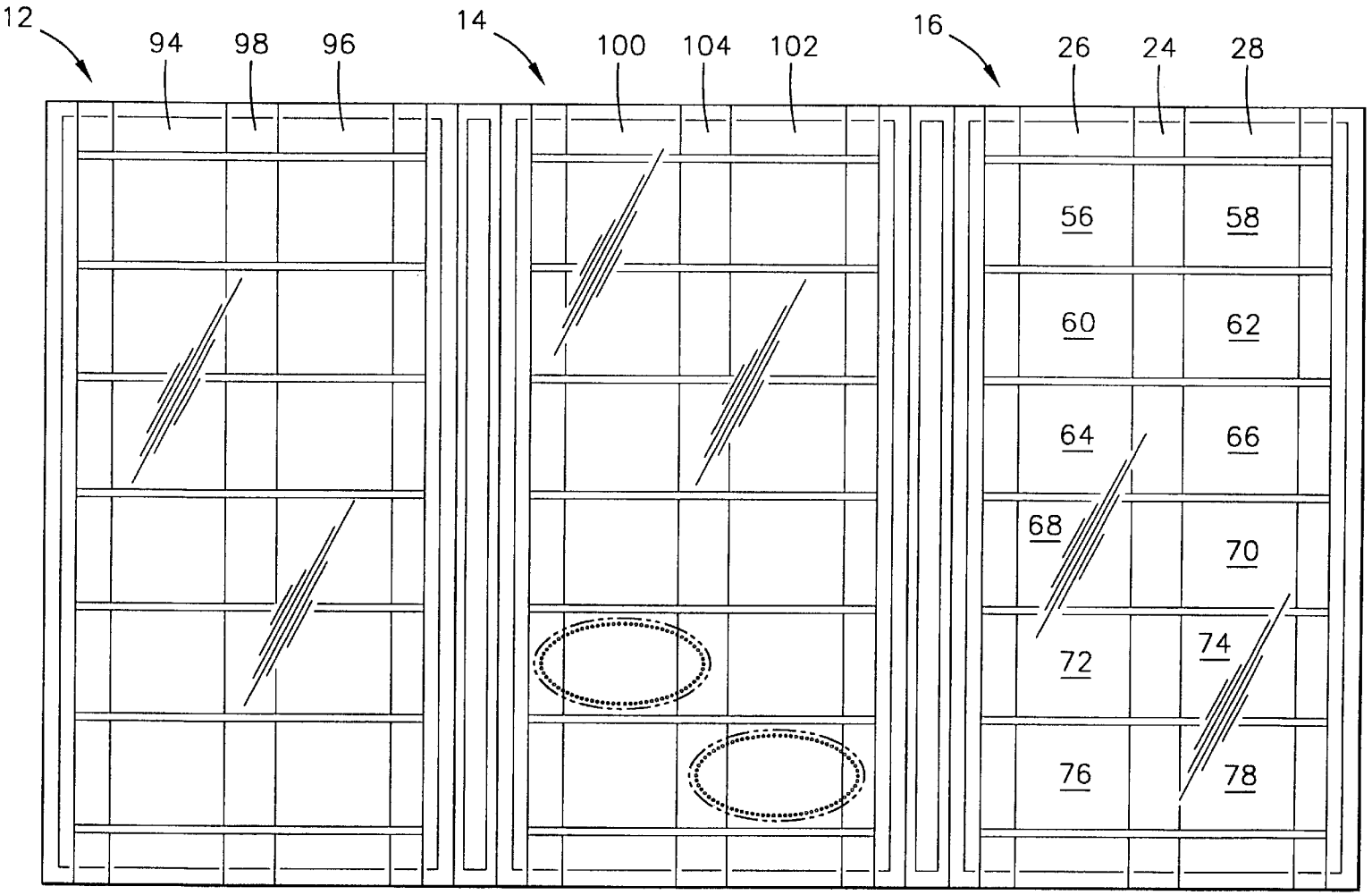
FIG. 3 is an elevation view showing the holder open showing the interior mounting surfaces of the front and back panels and one face of the interior mounting panel.

As will be appreciated from viewing FIGS. 1 and 3, the inside face of the front cover panel 12 and back cover panel 14 are each formed with multiple mounting positions or pockets on the inside surface of each of the panels. The multiple mounting positions or pockets are formed on the inner surfaces of the front and back panel and on both surfaces of the inner panel as will be appreciated from FIGS. 2 and 3.

The mounting faces of each of the panels are substantially identical in construction. Therefore, only one mounting face will be described in detail with it being understood that the remaining mounting faces are substantially identical.

Referring to FIG. 1, the inner mounting face of panel 16 will be described in detail. The panel 16 is of a generally rectangular configuration having a height exceeding its width and is preferably semi-rigid or substantially rigid. The panel is formed with or encased within a coating of a suitable elastomeric material over a semi-rigid panel such as a cardboard panel or the like. The mounting face is first covered by a thin sheet or film of material 24 such as a vinyl or the like which covers almost the entire panel extending from an inner edge 23 to an outer edge 25. This material may be transparent, but is preferably of a material having a substantially slick surface to enable the fairly easy sliding of the souvenirs or coins along the surface thereof.

A pair of elongated rectangular second and third retaining cover sheets 26 and 28 of a similar material are laid over the first sheet 24 and are sealed at multiple places along the panel. The cover sheets are shown extending vertically and are sealed at the upper and lower edges 30 and 32 to the underlying sheet and to the panel 16. As can be seen, each of the retaining sheets 26 and 28 have side edges 34, 36, 38 and 40 limiting the width thereof to less than that of the backing sheet. This leaves spacing between the two retaining sheets 26 and 28 and leaves space at both side edges to enable the slipping of a coin or souvenir into the space between the backing sheet and the covering sheet. It will be apparent that these retaining sheets may extend horizontally of the back panel in order to accommodate larger coins on the panel. The coins would be oriented vertically.

The two covering sheets 26 and 28 are bonded to the backing sheet and to the panel 16 at vertically-spaced horizontal lines 42, 44, 46, 48, 50, 52 and 54. This forms a plurality of generally rectangular mounting surfaces defining a pair of laterally disposed mounting positions at each level between each pair of horizontal bonding lines. The retaining sheets are preferably sufficiently tight or snug against the facing sheet to require forcing of the coin or souvenir therebetween. This arrangement thus provides mounting positions 56, 58, 60, 62, 64, 66, 68, 70, 72, 74, 76 and 78 on the inside face of panel 16.

This same arrangement and structure also forms a mounting face on the inside surface of the front and back panels 12 and 14 and as specifically described, with respect to the panel 16. A plurality of oval shaped souvenirs or coins 80, 82, 84 and 86 are shown mounted respectively in positions 60, 66, 74 and 76 on the inner mounting face of panel 16. The souvenirs are forced into the space between the retaining sheets and backing sheet and are securely retained in place.

Referring to FIG. 2, the back or outer mounting face of the inner panel 16 is illustrated. This mounting face is constructed substantially identical to that of the face shown in FIG. 1 with a pair of retaining cover sheets or strips 88 and 90 overlining a backing sheet 92 which covers the face of the panel. The retaining cover sheets or strips 88 and 90 are bonded as in the previously described section to the underlying sheet 92 and to the panel 16 at the uppermost edges and the lowermost edge 96. Similarly, the sheets are bonded together along multiple horizontal lines as illustrated dividing the mounting face of the panel into a plurality of mounting positions as previously described. For horizontally extending mounting sheets, the bonding would be along vertical lines.

Referring now to FIG. 3, it will be seen that the panels 12 and 14 have inner mounting faces on the inside surface that are substantially identical to those on the inner and outer mounting faces of panel 16. Specifically, the inner surface of panel 12 is provided with a pair of transparent retaining cover sheets 94 and 96 that overlie and are bonded to an underlying facing sheet 98 as described with respect to FIG. 2. This, likewise, forms a mounting face having a plurality of mounting positions souvenirs or coins as previously described.

The panel 14 is similarly provided with a pair of laterally spaced strips 100 and 102 overlying a backing sheet 104 and which are bonded together and to the inner surface of the panel as previously described along an upper edge and lower edge. These are also bonded together along multiple vertically spaced horizontal lines to provide a plurality of coin or souvenir mounting positions as previously described. The transparent retaining cover at each position securely holds the souvenirs in the respective mounting positions and enables viewing of the souvenirs. It will be apparent that the present holder is also suitable for holding regular (unaltered) coins and tokens. It will also be apparent that the mounting face or faces may be on one or more loose inner panels or sheets that can be added or removed, such as a three ring binder.

While we have illustrated and described our invention by means of specific embodiments, it is to be understood that numerous changes and modifications may be made therein without departing from the spirit and scope of the invention, as defined in the appended claims.

We claim:

1. A souvenir holder for holding and displaying souvenirs, comprising:

at least a front panel and a back panel secured together to fold about a common axis, each panel having an inside surface and an outside surface;

a planar mounting face on the inside surface of each of said front and back panels;

each mounting face having a plurality of planar mounting positions for receiving and mounting a coin; and each of said mounting positions defined by a transparent retaining cover attached solely along two side edges of each said mounting position to said mounting face and extending over each of said mounting positions thereby defining a space for receiving and mounting a coin snug against said mounting face.

2. A souvenir holder according to claim 1, further comprising an inner panel having a first mounting face and a second mounting face pivotally secured to one of said front and back panels.

3. A souvenir holder according to claim 2, wherein said inner panel is pivotally secured to said back panel.

4. A souvenir holder according to claim 3, wherein said inner panel having a plurality of mounting positions on opposite faces thereof.

5. A souvenir holder according to claim 4, wherein:

said mounting positions comprise a planar surface covered with a first vinyl sheet; and a transparent vinyl strip defining said retaining cover overlying and tight against said first sheet and defining said space for receiving a coin therebetween.

6. A souvenir holder according to claim 1, wherein each mounting face having a facing sheet.

7. A souvenir holder according to claim 6, wherein said each mounting face is divided into a plurality of vertically spaced rectangular areas, each rectangular area having two of said retaining cover defining a pair of laterally disposed mounting positions.

8. A souvenir holder according to claim 7, wherein said retaining cover enables insertion of a coin from each of two sides.

9. A souvenir holder according to claim 6, wherein said facing sheet and said transparent retaining cover are bonded together along vertically spaced horizontal lines defining a plurality of vertically spaced rectangular surfaces, each rectangular surface having said transparent retaining cover defining a pair of laterally disposed mounting positions.

10. A souvenir holder according to claim 9, further comprising an inner panel having front and back surfaces, said inner panel pivotally secured to said back panel and having a plurality of mounting positions on each of said front and back surfaces.

a mounting face on the inside surface of each of said front and back panels, and a mounting face on opposite faces of said inner panel;

each mounting face having a plurality of mounting positions for receiving and mounting a coin; and a transparent retaining sheet covering each of said mounting positions.

11. A souvenir holder according to claim 10, wherein said front panel and said back panel are substantially rigid and covered with an elastomer material enabling said panels to fold about said common axis.

12. A souvenir holder according to claim 1, wherein said front panel and said back panel are substantially rigid and covered with an elastomer material enabling said panels to fold about said common axis.

13. A holder for holding and displaying coins and souvenirs, comprising:

a plurality of laterally disposed panels comprising at least a front panel and a back panel secured together to hinge about a common axis along a common edge, and an inner panel pivotally secured to hinge about a common axis along a common edge of said back panel the front panel and back panel each having an inside surface and an outside surface;

a planar mounting face on the inside surface of each of said front and back panels, and a mounting face on opposite faces of said inner panel;

a transparent retaining sheet bonded to said mounting face solely along vertically spaced horizontal lines defining a plurality of vertically spaced mounting positions for receiving and mounting a coin.

14. A souvenir holder according to claim 13, wherein:

said mounting positions comprise a planar surface covered with a first vinyl sheet; and a transparent vinyl strip defining said retaining sheet, and covering said first sheet for receiving a coin therebetween.

15. A holder for holding and displaying coins and souvenirs, comprising:

a plurality of laterally disposed panels comprising at least a front panel and a back panel secured together to hinge about a common axis along a common edge, and an inner panel pivotally secured to hinge about a common axis along a common edge of said back panel, the front panel and back panel each having an inside surface and an outside surface;

a planar mounting face on the inside surface of each of said front and back panels, and a mounting face on opposite faces of said inner panel;

each mounting face is formed with a plurality of vertically spaced rectangular surfaces, each rectangular surface having a transparent retaining sheet defining a pair of laterally disposed mounting positions for receiving and mounting a coin or souvenir;

each mounting position defined by a planar surface bound by an upper and a lower groove; and said transparent retaining sheet attached solely along said upper and lower grooves to said mounting face and covering each of said mounting positions defining a space for receiving and mounting a coin snug against said mounting face.

16. A souvenir holder according to claim 15, wherein said mounting positions comprise a planar surface covered with a first vinyl sheet; and a transparent vinyl strip defining said retaining sheet, and covering said first sheet for receiving a coin therebetween.

17. A souvenir holder according to claim 15, wherein said each mounting face is divided into a plurality of vertically spaced rectangular areas, each rectangular area having two of said retaining sheet defining a pair of laterally disposed mounting positions.

* * * * *